United States Patent [19]

Burrows et al.

[11] Patent Number: 4,479,467

[45] Date of Patent: Oct. 30, 1984

[54] MULTIPLE SPARK CD IGNITION SYSTEM

[75] Inventors: Thomas W. Burrows, West Allis; David T. Cavil, Menominee Falls, both of Wis.

[73] Assignee: Outboard Marine Corporation, Waukegan, Ill.

[21] Appl. No.: 450,902

[22] Filed: Dec. 20, 1982

[51] Int. Cl.[3] ..... F02P 3/08

[52] U.S. Cl. ..... 123/606; 123/605; 123/637; 315/209 CD; 315/209 SC; 361/256

[58] Field of Search ..... 123/596, 605, 606, 637; 315/209 CD, 209 SC; 361/256, 257

[56] References Cited

U.S. PATENT DOCUMENTS

| | | | |
|---|---|---|---|
| 3,489,129 | 1/1970 | Issler et al. | 123/637 |
| 3,620,201 | 11/1971 | Warren et al. | 123/637 |
| 3,926,165 | 12/1975 | Merrick | 123/637 |
| 3,983,461 | 9/1976 | Jordan | 315/209 CD |
| 4,133,329 | 1/1979 | Caron | 123/637 |
| 4,149,508 | 4/1979 | Kirk, Jr. et al. | 123/637 |

*Primary Examiner*—Andrew M. Dolinar
*Attorney, Agent, or Firm*—Michael, Best & Friedrich

[57] ABSTRACT

Disclosed herein is a multiple spark circuit for use with a capacitor discharge ignition system including a current supply, a charge capacitor, an ignition coil primary winding, and an ignition timing SCR. The multiple spark circuit includes a charge reservoir capacitor connected to the current supply, a restrike circuit subject to the timing SCR, and to the voltage and discharge current of the charge capacitor, for allowing repeated charging and discharging of the charge capacitor to produce multiple ignition sparks at each ignition timing point, and a charge interrupt circuit, subject to the restrike circuit, for allowing repeated charging of charge capacitor by the charge reservoir capacitor at each ignition timing point. The restrike circuit preferably comprises a thyristor connected to the timing SCR and charge capacitor, and a zener diode connected to the thyristor gate and anode to render the thyristor conductive when the charge capacitor voltage exceeds a predetermined upper limit. The charge interrupt circuit preferably includes a Darlington transistor connected between the charge reservoir capacitor and the charge capacitor, with the base connected to the current supply and to the ignition coil primary winding, whereby, when the charge capacitor is discharging, the base current is shunted to interrupt charging of the charge capacitor by the charge reservoir capacitor.

32 Claims, 5 Drawing Figures

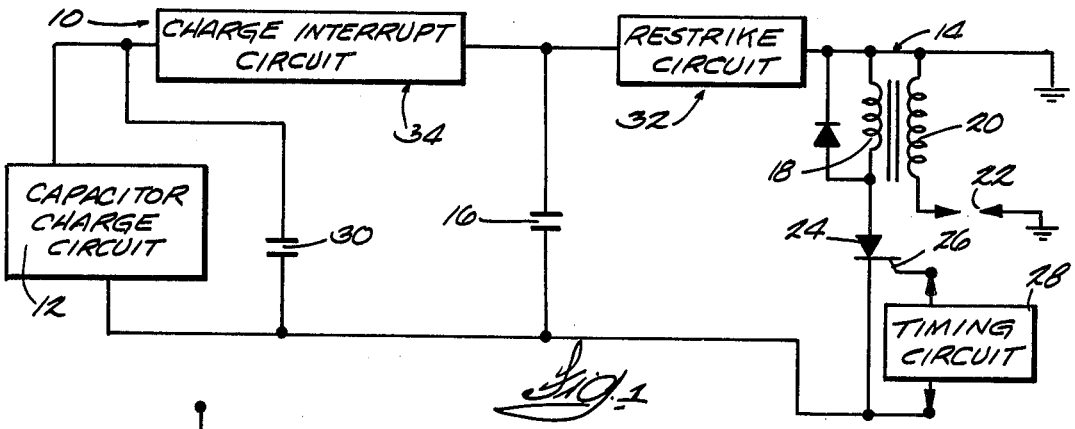
Fig. 1
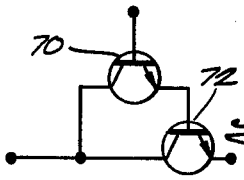
Fig. 3
Fig. 5
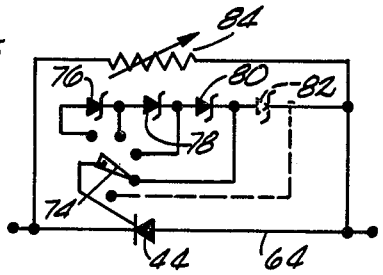
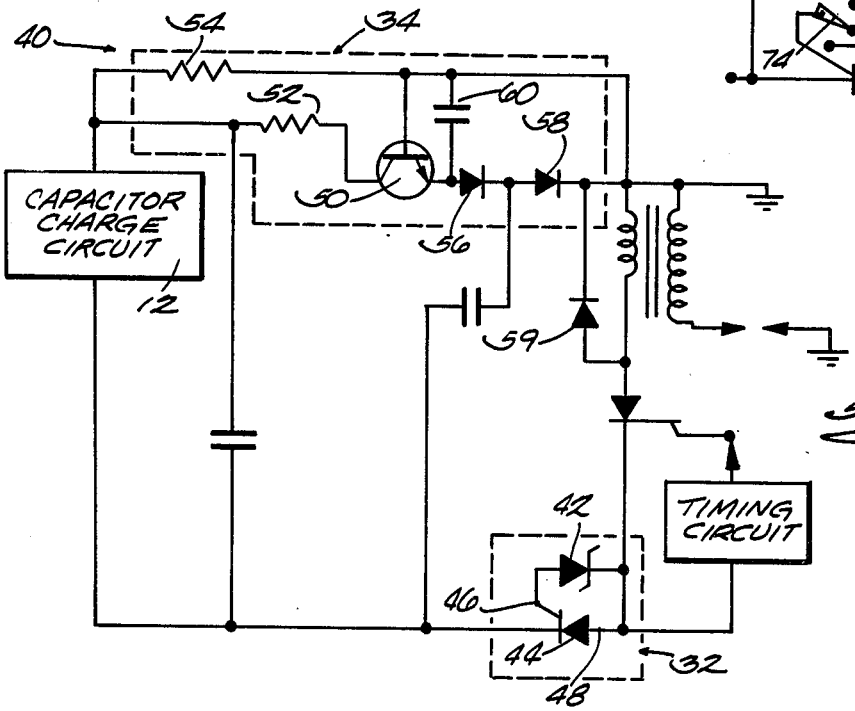
Fig. 2
Fig. 4
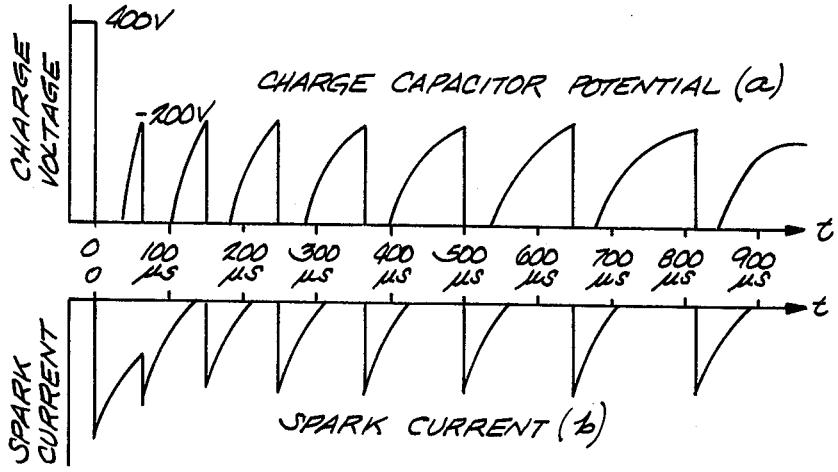

MULTIPLE SPARK CD IGNITION SYSTEM

BACKGROUND OF THE INVENTION

The invention relates to multiple spark ignition systems for internal combustion engines, and more particularly to a capacitor discharge ignition system for providing multiple sparks at each ignition timing point. Attention is directed to the following U.S. patents:

| | | |
|---|---|---|
| Posey | 3,718,125 | issued 2/27/73 |
| Kato et al | 3,809,041 | issued 5/7/74 |
| Bruijning et al | 3,839,659 | issued 10/1/74 |
| Howard | 3,866,590 | issued 2/18/75 |
| Hufton | 3,885,541 | issued 5/27/75 |
| Pulzer | 3,918,425 | issued 11/11/75 |
| Merrick | 3,926,165 | issued 12/16/75 |
| Asik et al | 3,934,570 | issued 1/27/76 |
| Jordan | 3,983,461 | issued 9/28/76 |
| Manger et al | 4,112,890 | issued 9/12/78 |
| Caron | 4,133,329 | issued 1/9/79 |
| Merrick | 4,131,100 | issued 12/26/78 |
| Grather et al | 4,138,977 | issued 2/13/79 |
| Gerry | 4,140,946 | issued 2/20/79 |
| Kirk, Jr. et al | 4,149,508 | issued 4/17/79 |
| Forster | 4,154,205 | issued 5/15/79 |
| Grather et al | 4,181,122 | issued 1/1/80 |

SUMMARY OF THE INVENTION

The invention provides a multiple spark circuit adapted for use with a CD ignition system adapted for connection to a capacitor charge circuit and including a charge capacitor, an ignition coil including a primary winding, and an ignition timing circuit including a timing switch for allowing selective discharge of the charge capacitor through the primary winding. The multiple spark circuit includes a charge reservoir capacitor adapted for connection to the capacitor charge circuit, restrike circuit means, subject to the timing switch, and to the voltage and discharge current of the charge capacitor to produce multiple ignition sparks at each ignition timing point, and charge interrupt circuit means, subject to the restrike circuit means, for allowing repeated charging of the charge capacitor by the charge reservoir capacitor at each ignition timing point.

The invention also provides a multiple spark capacitor discharge ignition system adapted for connection to a capacitor charge circuit providing a current supply ignition system comprising a charge capacitor, an ignition coil including a primary winding, an ignition circuit including a timing switch for allowing selective discharge of the charge capacitor through the primary winding to produce an ignition spark, and a multiple spark circuit as described above. In one embodiment of the invention, the restrike circuit means is rendered conductive and allows discharge of the charge capacitor when the charge capacitor voltage exceeds a predetermined upper limit, and is rendered nonconductive and prevents further discharge of the charge capacitor when the charge capacitor discharge current drops below a predetermined lower limit. The charge interrupt circuit means is rendered nonconductive and prevents charging of the charge capacitor by the charge revervoir capacitor when the restrike circuit means allows for discharge of the charge capacitor, and the charge interrupt circuit means is rendered conductive and allows for charging of the charge capacitor by the charge reservoir capacitor when the restrike circuit means prevents further discharge of the charge capacitor.

In one embodiment of the invention, the restrike circuit means comprises restrike switch means, preferably a thyristor, connected to the timing switch and the charge capacitor, and voltage threshold means, preferably a zener diode, connected to the thyristor gate and anode for rendering the thyristor conductive when the charge capacitor voltage exceeds the predetermined upper limit, for example 200 volts. Also the charge interrupt circuit means comprises interrupt switch means, preferably a Darlington transistor, connected to the charge reservoir capacitor and the charge capacitor and having a base or third terminal connected to a current supply and to the primary winding whereby, when the charge capacitor is discharged the current applied from the current supply to the base is shunted so that the transistor is rendered non-conductive to prevent charging of the charge capacitor by the charge reservoir capacitor and whereby, when the restrike circuit means prevents further discharge of the charge capacitor, the current from the supply is applied to the base and renders the transistor conductive to allow charging of the charge capacitor by the reservoir capacitor.

One of the principal features of the invention is the provision of a multiple spark circuit for a capacitor discharge ignition system which provides multiple sparks for each ignition timing point and can be operated by a capacitor charge circuit including an alternator, rather than a power oscillator run from a battery.

Another of the principal features of the invention is the provision of such a multiple spark ignition system which includes a restrike circuit with switch means to select the voltage at which the multiple sparks will be applied.

Other features and advantages of the invention will become apparent from the following general description, drawing and appended claims.

FIG. 1 is a diagrammatic circuit drawing showing a multiple spark CD ignition system which embodies various of the features in the invention.

FIG. 2 is a schematic circuit showing in more detail a multiple spark CD ignition system which embodies various of the features in the invention.

FIG. 3 is a schematic circuit of a substitute arrangement for a portion of the circuit shown in FIG. 2, and illustrates another embodiment of the invention.

FIG. 4 is a diagrammatic view of the charge capacitor voltage and the ignition spark current provided by the ignition system shown in FIG. 2.

FIG. 5 is a schematic circuit of a substitute arrangement for a portion of the circuit shown in FIG. 2, and illustrates another embodiment of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology employed herein is for the purpose of description and should not be regarded as limiting.

GENERAL DESCRIPTION

Referring more particularly to the drawing, wherein like numerals refer to like parts throughout the several views, FIG. 1 diagrammatically shows a multiple spark capacitor discharge ignition system 10 which embodies various features of the invention. Generally, the system 10 includes a suitable capacitor charge circuit 12, which does not require a battery and which includes, for example, an alternator and rectifier circuitry (not shown), to provide a direct current supply to allow for charging of a charge capacitor 16. The system 10 also includes an ignition coil 14 including a primary winding 18 and a secondary winding 20 which causes an ignition spark across the contacts of the spark plug 22 each time the charge capacitor 16 discharges through primary winding 18. The discharge of the charge capacitor 16 is controlled, in part, by a suitable timing circuit including switch means such as a thyristor or ignition timing SCR 24, which is rendered conductive upon application of a trigger pulse applied to gate 26 of SCR 24 for example, by a trigger coil (not shown) incuded in timing circuit 28. The preceding components of a CD ignition system are generally conventional in nature, so that greater detail of description is not necessary for one skilled in the art.

The ignition system 10 also includes a multiple spark circuit which includes a charge reservoir capacitor 30 connected to the capacitor charge circuit 12 as shown. This capacitor is relatively large, for example, three to five microfarads, compared to the charge capacitor, for example, 0.5 microfarads. The multiple spark circuit of system 10 also includes restrike circuit means, generally designated 32, which, subject to the ignition SCR 24 and to the voltage and discharge current of the charge capacitor 16, is operative for allowing repeated charging and discharging of the charge capacitor 16 to produce multiple ignition sparks at each ignition timing point. The multiple spark circuit of system 10 also includes charge interrupt circuit means, generally designated 34, which, subject to said restrike circuit means, is operative for allowing repeated charging of the charge capacitor 16 by the charge reservoir capacitor 30 at each ignition timing point.

As will be described in further detail below, the restrike circuit means 32 is rendered conductive and allows for discharge of the charge capacitor 16 when the charge capacitor voltage exceeds a predetermined upper limit, and is rendered nonconductive and prevents further discharge of the charge capacitor 16 when the charge capacitor discharge current drops below a predetermined lower limit. The charge interrupt circuit means 34 is rendered nonconductive to prevent charging of the charge capacitor 16 by the charge reservoir capacitor 30 when the restrike circuit means 32 allows for discharge of the charge capacitor 16, and the charge interrupt means is rendered conductive and allows for charging of the charge capacitor 16 by the charge reservoir capacitor 12 when the restrike circuit means prevents further discharge of the charge capacitor 16.

Shown in FIG. 2 is a multiple spark CD ignition system 40 which illustrates the restrike circuit means and charge interrupt circuit means in greater detail, and which embodies various features of the invention. While various restrike circuit means arrangements are possible, in the illustrated preferred embodiment, such means comprises voltage threshold means, preferably in the form of a zener diode 42, connected to restrike switch means, preferably in the form of a thyristor or restrike SCR 44. The zener diode 42 is connected to the gate 46 and anode 48 of SCR 44 so that it breaks down to gate and render SCR 44 conductive when the voltage of the charge capacitor 16 exceeds a predetermined upper limit, for example, 200 volts.

While various charge interrupt circuit means arrangements are possible, in the illustrated preferred embodiment, such means preferably comprises interrupt switch means, preferably in the form of a Darlington transistor 50, resistors 52 and 54, diode 56 and 58, and a capacitor 60 connected as shown. As will be described further below, FIG. 3 illustrates a circuit which can make up Darlington transistor 50. Also as will be described further below, FIG. 5 illustrates a modified restrike circuit means, generaly designated 64, which can be substituted for the restrike circuit means 32 and which allows two ways to vary the restriking characteristics of the ignition system 40. The output characteristics shown in FIG. 4 will also be discussed in the description of operation below.

In operation, the multiple spark CD ignition system 40 functions as follows. The charge reservoir capacitor is charged to approximately 400 to 500 volts by the capacitor charge circuit 12. The Darlington transistor 50 is rendered conductive or turned on by a base current flowing through resistor 54 trying to charge capacitor 16. When Darlington transistor 50 turns on, the charge capacitor 16 is charged from the charge reservoir capacitor 30 through resistor 52 and transistor 50. The charge capacitor 16 is initially charged to the same voltage as charge reservoir capacitor 30, as shown in FIG. 4(*a*). When a timing pulse or trigger voltage is supplied by the timing circuit 28, the ignition timing SCR 24 turns on and the charge capacitor 16 discharges through diode 58, the ignition coil primary winding 18, the timing SCR 24 and the restrike circuit means 32. The SCR 44 of the restrike circuit turns on as soon as its anode voltage exceeds a predetermined upper limit, for example, 200 volts, by virtue of the zener diode 42 connected from the SCR anode to gate as shown. The base current of transistor 50 is shunted when the timing and restrike SCRs are conducting. This prevents discharge of the charge reservoir capacitor 30 through the timing SCR circuit, but allows charge capacitor 16 to be recharged when the restrike circuit means recovers its blocking ability. This happens when the charge capacitor discharge current drops below a predetermined lower limit and, together with the transistor base current, the sum of these currents drops below the holding current of the restrike SCR 44, and thus the SCR 44 recovers and is rendered nonconductive. In order to have the restrike SCR 44 recover, the current through resistor 54 must be less than the restrike SCR holding current, for example, less than 10 milliamps.

The Darlington transistor 50 is selected so that it can be turned on with a base current less than 10 milliamps, but so it can conduct approximately 4 amps to allow rapid recharging of the charge capacitor 16. To accomplish this, the transistor 50 must have a current gain of about 500 at 4 amps, and be able to shut off against 400 to 500 volts. FIG. 4 shows the circuit which can be used to make up transistor 50 shown in FIG. 2. It is a Darlington connection of two transistors 70 and 72. Transistor 72 is already a Darlington connected transistor so a "double-Darlington" system is used to get the necessary current gain at the high currents. Referring back to FIG. 2 diode 56 is used to prevent too large a reverse base-emitter voltage on transistor 50 when capacitor 16 discharges. A diode 59 is provided as a free wheeling diode for the ignition coil 14. Capacitor 60 is to prevent false triggering or false turn on of transistor 50.

Returning to a description of operation, when the restrike circuit means recovers so that restrike SCR 44 is rendered nonconductive, Darlington transistor 50 is again biased on by a base current flowing through resistor 54. The charge capacitor 16 begins charging from charge reservoir capacitors 30. Charge capacitor 16 charges until it reaches said predetermined upper limit, for example, 200 volts. Assuming the timing SCR 24 is still gated by a timing pulse, 200 volts is sufficient to gate the restrike SCR 44 and charge capacitor 16 is again discharged through diode 58 and primary winding 18, causing another ignition spark and shutting off Darlington transistor 50 to preserve the charge remaining in charge reservoir 30. The ignition circuit 40 continues to operate in this manner until charge reservoir capacitor 30 can no longer charge charge capacitor 16 to 200 volts, or until the timing pulse no longer gates the timing SCR 24.

Referring to FIG. 4, FIG. 4(*a*) shows the charge voltage on charge capacitor 16 during the sequence. The charge time for charge capacitor 16 increases with subsequent pulses because the voltage difference between charge reservoir capacitor 30 and the charge capacitor 16 is decreasing. FIG. 4(*b*) shows the ignition spark current wave form. The first current pulse is the result of a discharge of charge capacitor 16 with a 400 to 500 volt charge. This first pulse overlaps into the first restrike pulse, with the result being almost a continuous current for over 200 microseconds if the second restrike pulse is included.

FIG. 5 shows an alternative restrike circuit generally designated 64, which could be substituted for restrike circuit means 32, and provides two ways in which the restriking characteristics of the ignition system can be varied. The first way is the use of a switch 74 to select at which voltage the restrike SCR 44 will be gated by tapping a string of zener diodes 76, 78, 80 and 82. The higher the voltage, the more energy is put into each restrike. There are correspondingly fewer restrikes, however, because the charge reservoir capacitor 30 is more quickly depleted. The second way is the use of a variable shunting resistor 84 connected as shown. As the resistance of the variable shunting resistor 84 is made smaller, more base current will be shunted from Darlington transistor 50, even when the restrike SCR 44 has recovered and is nonconductive. This has the effect of preventing charge capacitor 16 from being recharged at the lower charge voltages of charge reservoir capacitor 30. Thus, the restrikes will have the same energy but will become fewer until only initial firing remains. In this case, charge capacitor 16 cannot recharge until the timing SCR 24 recovers and that particular ignition timing point is past.

The invention is also useful for multiple cylinder arrangements, requiring only an additional ignition coil, timing circuit including an ignition SCR and spark plug for such additional cylinder. Accordingly, it is to be understood that the invention is not confined to the particular construction and arrangement of components as herein illustrated and described, but embraces all such modified forms thereof as come within the scope of the following claims.

We claim:

1. A multiple spark circuit adapted for use with a CD ignition system adapted for connection to a capacitor charge circuit and including a charge capacitor, an ignition coil including a primary winding, and an ignition timing circuit including a timing switch for allowing selective discharge of the charge capacitor through the primary winding to produce an ignition spark, said multiple spark circuit comprising a charge reservoir capacitor adapted for connection to the capacitor charge circuit, restrike circuit means, subject to the timing switch, and to the voltage and discharge current of the charge capacitor, for allowing repeated charging and discharging of the charge capacitor to produce multiple ignition sparks at each ignition timing point, and charge interrupt circuit means, subject to said restrike circuit means, for allowing repeated charging of the charge capacitor by said charge reservoir capacitor at each ignition timing point.

2. A multiple spark circuit in accordance with claim 1 wherein said restrike circuit means allows discharge of the charge capacitor when the charge capacitor voltage exceeds a predetermined upper limit, and prevents further discharge of the charge capacitor when the charge capacitor discharge current drops below a predetermined lower limit.

3. A multiple spark circuit in accordance with claim 2 wherein said charge interrupt circuit means prevents charging of the charge capacitor by said charge reservoir capacitor when said restrike circuit means allows for discharge of the charge capacitor, and said charge interrupt circuit means allows for charging of the charge capacitor by said charge reservoir capacitor when said restrike circuit means prevents further discharge of the charge capacitor.

4. A multiple spark circuit in accordance with claim 3 wherein said restrike circuit means is rendered conductive when the charge capacitor voltage exceeds a predetermined upper limit, and is rendered nonconductive when the charge capacitor discharge current drops below said predetermined lower limit.

5. A multiple spark ignition circuit in accordance with claim 3 wherein said charge interrupt circuit means is rendered conductive when said restrike circuit means is rendered nonconductive, and said charge interrupt circuit means is rendered nonconductive when said restrike circuit means is rendered conductive.

6. A multiple spark circuit in accordance with claim 1 wherein said restrike circuit means comprises restrike switch means the timing switch and the charge capacitor, and voltage threshold means connected to said restrike switch means for rendering said restrike means conductive when the charge capacitor voltage exceeds said predetermined upper limit.

7. A multiple spark circuit in accordance with claim 6 wherein said restrike switch means comprises a thyristor having a gate and anode, and wherein said voltage threshold means is connected to said gate and anode, said threshold means being rendered conductive to gate said thyristor when the charge capacitor voltage exceeds said predetermined upper limit.

8. A mutliple spark circuit in accordance with claim 7 wherein said voltage threshold means comprises a zener diode.

9. A multiple spark circuit in accordance with claim 8 wherein said voltage threshold means comprises a string of zener diodes, and wherein said restrike switch means also comprises switch means for tapping said string of zener diodes to allow varying said predetermined upper limit and thus the voltage at which the multiple sparks will be applied.

10. A multiple spark circuit in accordance with claim 6 wherein said charge interrupt circuit means comprises interrupt switch means connected to said charge reservoir capacitor and the charge capacitor and having a terminal connected to a current supply and to the primary winding whereby, when said charge capacitor is discharged the current applied from the current supply to said terminal is shunted so that said interrupt switch means is rendered nonconductive to prevent charging of the charge capacitor by said charge reservoir capacitor and whereby, when said restrike circuit means prevents further discharge of said charge capacitor, current from the current supply is applied to said terminal and renders said interrupt switch means conductive to allow charging of the charge capacitor by said reservoir capacitor.

11. A multiple spark circuit in accordance with claim 10 wherein said restrike switch means comprises a thyristor having a gate and anode, and wherein said voltage threshold means is connected to said gate and anode, said threshold means being rendered conductive to gate said thyristor when the charge capacitor voltage exceeds said predetermined upper limit, and wherein said interrupt switch means comprises a Darlington transistor having collector and emitter terminals connected between said charge reservoir capacitor and the charge capacitor, and a base terminal which comprises said terminal connected to the current supply and to the primary winding of the ignition coil.

12. A multiple spark circuit in accordance with claim 1 wherein said charge interrupt circuit means comprises interrupt switch means connected to said charge reservoir capacitor and said charge capacitor and having a terminal connected to a current supply and to the primary winding, whereby, when said charge capacitor is discharged, the current applied to said third terminal is shunted so that said interrupt switch means is rendered nonconductive to prevent charging of the charge capacitor by said charge reservoir capacitor, and whereby, when said restrike circuit means prevents further discharge of said charge capacitor, the current applied to said terminal renders said interrupt switch means conductive to allow charging of the charge capacitor by said charge reservoir capacitor.

13. A multiple spark circuit in accordance with claim 12 wherein said interrupt switch means comprises a Darlington transistor having collector and emitter terminals connected between said charge reservoir capacitor and the charge capacitor, and a base terminal which comprises said terminal connected to the current supply and to the primary winding of the ignition coil.

14. A multiple spark circuit in accordance with claim 13 and further comprising a resistor connected between the current supply and said base terminal, and wherein the base current operative to render said transistor conductive is less than current flow required to maintain said restrike circuit means conductive.

15. A multiple spark circuit in accordance with claim 13 and further comprising a diode connected between said transistor and said charge capacitor to prevent excessive base-emitter voltage when the charge capacitor discharges.

16. A multiple spark circuit in accordance with claim 15 and further comprising a capacitor connected between said base and the anode of said diode to prevent false triggering of said transistor.

17. A multiple spark capacitor discharge ignition system adapted for connection to a capacitor charge circuit providing a current supply, said ignition system comprising a charge capacitor, an ignition coil including a primary winding, an ignition circuit including a timing switch for allowing selective discharge of said charge capacitor through said primary winding to produce an ignition spark, and a multiple spark circuit comprising a charge reservoir capacitor adapted for connection to the capacitor charge circuit, restrike circuit means, subject to said timing switch, and to the voltage and discharge current of said charge capacitor, for allowing repeated charging and discharging of said charge capacitor to produce multiple ignition sparks at each ignition timing point, and charge interrupt circuit means, subject to said restrike circuit means, for allowing repeated charging of said charge capacitor by said charge reservoir capacitor at each ignition timing point.

18. An ignition system in accordance with claim 17 wherein said restrike circuit means allows discharge of said charge capacitor when the charge capacitor voltage exceeds a predetermined upper limit, and prevents further discharge of said charge capacitor when the charge capacitor discharge current drops below a predetermined lower limit.

19. An ignition system in accordance with claim 18 wherein said charge interrupt circuit means prevents charging of said charge capacitor by said charge reservoir capacitor when said restrike circuit means allows for discharge of said charge capacitor, and said charge interrupt circuit means allows for charging of said charge capacitor by said charge reservoir capacitor when said restrike circuit means prevents further discharge of said charge capacitor.

20. An ignition system in accordance with claim 19 wherein said restrike circuit means is rendered conductive when said charge capacitor voltage exceeds a predetermined upper limit, and is rendered nonconductive when said charge capacitor discharge current drops below said predetermined lower limit.

21. An ignition system in accordance with claim 19 wherein said charge interrupt circuit means is rendered conductive when said restrike circuit means is rendered nonconductive, and said charge interrupt circuit means is rendered nonconductive when said restrike circuit means is rendered conductive.

22. An ignition system in accordance with claim 17 wherein said restrike circuit means comprises restrike switch means connected to said timing switch and said charge capacitor, and voltage threshold means connected to said restrike switch means for rendering said restrike switch means conductive when said charge capacitor voltage exceeds said predetermined upper limit.

23. An ignition system in accordance with claim 22 wherein said restrike switch means comprises a thyristor having a gate and anode, and wherein said voltage threshold means is connected to said gate and anode, said threshold means being rendered conductive to gate said thyristor when said charge capacitor voltage exceeds said predetermined upper limit.

24. An ignition system in accordance with claim 23 wherein said voltage threshold means comprises a zener diode.

25. An ignition system in accordance with claim 24 wherein said voltage threshold means comprises a string of zener diodes, and wherein said restrike switch means also comprises switch means for tapping said string of zener diodes to allow varying said predetermined upper limit and thus the voltage at which the multiple sparks will be applied.

26. An ignition system in accordance with claim 22 wherein said charge interrupt circuit means comprises interrupt switch means connected to said charge reservoir capacitor and said charge capacitor and having a terminal connected to the current supply and to said primary winding whereby, when said charge capacitor is discharged, current applied from the current supply to said terminal is shunted so that said interrupt switch means is rendered nonconductive to prevent charging of said charge capacitor by said charge reservoir capacitor and whereby, when said restrike circuit means prevents further discharge of said charge capacitor, current from said current supply is applied to said terminal and renders said interrupt switch means conductive to allow charging of said charge capacitor by said reservor capacitor.

27. An ignition system in accordance with claim 26 wherein said restrike switch means comprises a thyristor having a gate and anode, and wherein said voltage threshold means is connected to said gate and anode, said threshold means being rendered conductive to gate said thyristor when said charge capacitor voltage exceeds said predetermined upper limit, and wherein said interrupt switch means comprises a Darlington transistor having collector and emitter terminals connected between said charge reservoir capacitor and the charge capacitor, and a base terminal which comprises said terminal connected to the current supply and to the primary winding of the ignition coil.

28. An ignition system in accordance with claim 17 wherein said charge interrupt circuit means comprises interrupt switch means connected to said charge reservoir capacitor and said charge capacitor and having a terminal connected to the current supply and to said primary winding, whereby, when said charge capacitor is discharged, the current applied from the current supply to said third terminal is shunted so that said interrupt switch means is rendered nonconductive to prevent charging of said charge capacitor by said charge reservoir capacitor, and whereby, when said restrike circuit means prevents further discharge of said charge capacitor, the current applied to said terminal renders said interrupt switch means conductive to allow charging of said charge capacitor by said charge reservoir capacitor.

29. An ignition system in accordance with claim 28 wherein said interrupt switch means comprises a Darlington transistor having collector and emitter terminals connected between said charge reservoir capacitor and said charge capacitor, and a base terminal which comprises said terminal connected to the current supply and to said primary winding of the ignition coil.

30. An ignition system in accordance with claim 29 and further comprising a resistor connected between the current supply and said base terminal, and wherein the base current operative to render said transistor conductive is less than current flow required to maintain said restrike circuit means conductive.

31. An ignition system in accordance with claim 29 and further comprising a diode connected between said transistor and said charge capacitor to prevent excessive base-emitter voltage when the charge capacitor discharges.

32. An ignition system in accordance with claim 31 and further comprising a capacitor connected between said base and the anode of said diode to prevent false triggering of said transistor.

* * * * *